United States Patent [19]

Gallimore

[11] 4,179,113

[45] Dec. 18, 1979

[54] APPARATUS FOR FEEDING LEAFLETS TO RAPIDLY MOVING ARTICLES

[75] Inventor: Claris C. Gallimore, Lake Villa, Ill.

[73] Assignee: F. D. Graphics, Inc., Lake Villa, Ill.

[21] Appl. No.: 867,714

[22] Filed: Jan. 9, 1978

[51] Int. Cl.[2] ..... B65H 5/08

[52] U.S. Cl. ..... 271/12; 271/132; 271/134; 271/166

[58] Field of Search ..... 271/5, 6, 12, 13, 132, 271/134, 166, 220

[56] References Cited

U.S. PATENT DOCUMENTS

| | | | |
|---|---|---|---|
| 2,352,088 | 6/1944 | Evans | 271/132 X |
| 2,753,185 | 7/1956 | Johnson | 271/220 |
| 2,827,290 | 3/1958 | Dixon | 271/132 X |
| 3,260,519 | 7/1966 | Coleman | 271/5 |
| 3,285,605 | 11/1966 | Vasse | 271/166 |
| 3,973,768 | 8/1976 | Shannon | 271/132 X |

*Primary Examiner*—Richard A. Schacher
*Attorney, Agent, or Firm*—Edmond T. Patnaude

[57] ABSTRACT

There is described apparatus for selectively feeding leaflets or the like from a stack into or onto rapidly moving articles such as open packages, which apparatus employs a reciprocable vacuum head which removes the leaflets seriatem from the stack and places them between continuously moving belts which transport the leaflets to the articles.

15 Claims, 9 Drawing Figures

APPARATUS FOR FEEDING LEAFLETS TO RAPIDLY MOVING ARTICLES

The present invention relates in general to apparatus for inserting separate sheets of material such as leaflets or coupons into or onto packages or the like as the packages move past the inserting apparatus, and it relates in particular to new and improved apparatus of this general type which employs novel means for removing the leaflets one by one from a stack and feeding them seriatem to the packages or other articles.

BACKGROUND OF THE INVENTION

Present day merchandising techniques commonly utilize coupons or other leaflets placed in the packages containing the product to be sold. There is a need for an automatically operated leaflet inserter inasmuch as the time and cost of inserting the leaflets by hand is not economically practical. During the packaging of the product, the open packages commonly travel along a conveyor at speeds in the range of hundreds of packages per minute wherefor such leaflets must be inserted into the packages at a very high rate of speed. When operated in this high range of speeds the prior art type leaflet feeders frequently jammed wherefor leaflets were not placed in every package. On the other hand, however, two or more leaflets were sometimes inadvertently inserted into each of the packages. Both of these situations are of course, undesirable.

SUMMARY OF THE INVENTION

Briefly, there is provided in accordance with various features of the present invention a leaflet feeder wherein a stack of leaflets are fed by gravity to a reciprocal feeder incorporating a suction head which removes the leaflets one by one from the stack and places them individually between pairs of continuously traveling conveyor belts which transport and propel the leaflets individually and at a high rate of speed either into or onto rapidly moving packages or the like.

In accordance with another aspect of the invention, novel restrictors are mounted in an inclined leaflet magazine partially to support the stack of leaflets in the magazine and thereby to prevent the weight of the stack from overpowering the vacuum feed system.

In accordance with a further aspect of the invention, all of the suction orifices in the vacuum feed head are continuously connected to a vacuum pump, and the suction of each leaflet to the head is relieved as the leaflet is fed to the associated conveyor belts in the transport assembly. Inasmuch as all of the orifices are connected to a common manifold chamber in the head, this simultaneously releases the suction at all of the orifices thereby to free the leaflet from the head. In order to break the suction as a leaflet is fed to the conveyor belts, the leading edge of the leaflet is physically peeled away from the feed head as the leaflet is fed to the conveyor belts.

Parallel slots positioned on opposite sides of the reciprocable vacuum head prevent the edges of curled or otherwise distorted leaflets from holding the central part of the leaflet away from the suction orifices in the head.

Where the leaflets are to be inserted into an opening in a package or other article, an angularly adjustable nozzle is provided at the end of the conveyor to direct the propelled leaflets into the opening in the packages.

Where the leaflets are to be laid down flat on a surface of a package or other article, a freely rotatable roller carried at the end of the conveyor rides directly on the packages or other articles as they move past the inserter, and the leaflets are propelled into the nip of the roller which thus keeps the leaflets from bouncing or floating away from the desired locations on the articles.

GENERAL DESCRIPTION OF THE DRAWINGS

The above and further features of the present invention will be better understood from a reading of the following detailed description taken in connection with the accompanying drawings where:

DETAILED DESCRIPTION OF THE INVENTION

Figure 1:
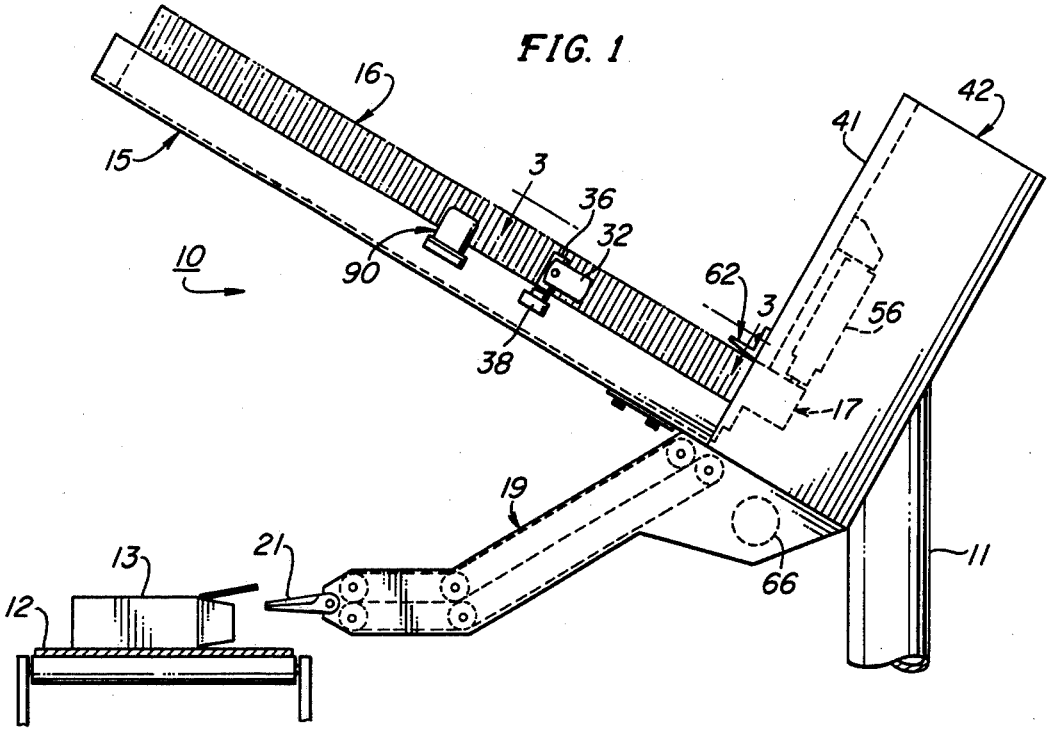
FIG. 1 is a side elevational view of a leaflet inserter embodying the present invention.

Referring now to the drawings and particularly to FIG. 1 thereof, a leaflet inserting apparatus embodying the present invention is generally identified by the reference character 10 and is shown mounted by suitable means such as a post 11 adjacent to a conveyor 12 carrying a plurality of open packages 13. Ordinarily the conveyor 12 is part of a packaging line and the inserting apparatus 10 is mounted adjacent to the conveyor at a location at which the packages have been formed but have not yet been closed. As will be apparent to those skilled in the art, the leaflets may be placed in the packages 13 prior to or after the product has been placed in the package and, moreover, the leaflets may be placed at any desired location or in any particular orientation within each package.

The apparatus 10 includes as its basic elements a leaflet magazine in the form of an inclined feed tray or chute 15 adapted to contain a stack of the leaflets 16 in face-to-face relationship, a reciprocating suction feed head 17 which removes the leaflets one by one from the stack 16 and feeds them to a multiple belt transport assembly 19 which transports the leaflets seriatem to an angularly adjustable inserter nozzle 21 which, as shown in FIG. 1, directs the leaflets into the packages 13 as they move past the mouth of the nozzle 21. It will be understood by those skilled in the art that the leaflets are fed from the nozzle 21 in synchronism with the movement of the packages 13 past the nozzle by any suitable control means, which control means does not form a part of the present invention.

Figure 3:
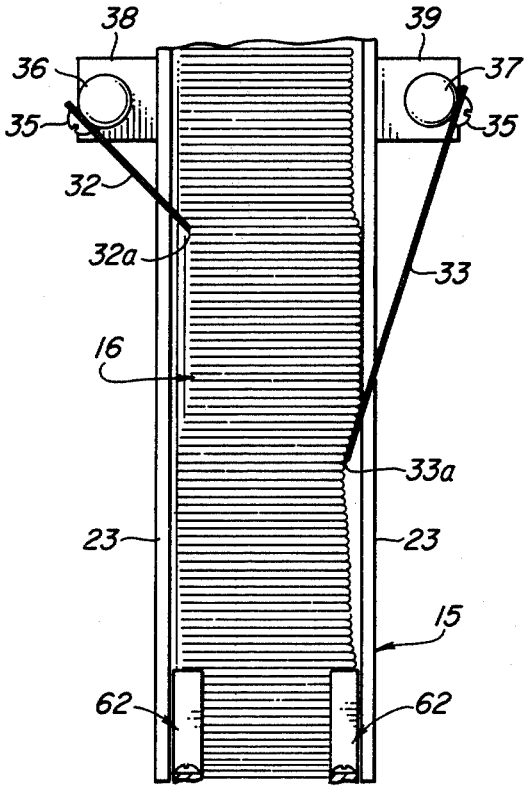
FIG. 3 is a cross-sectional view taken along the line 3—3 of FIG. 1.
Figure 4:
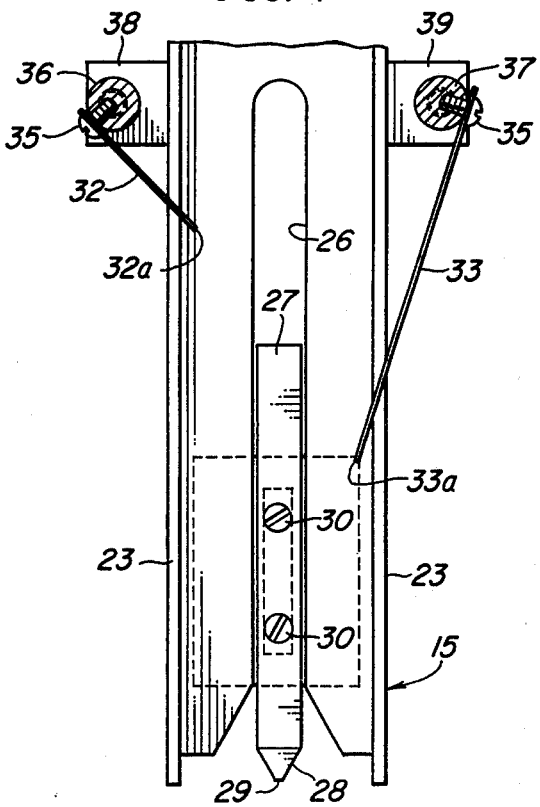
FIG. 4 is a cross-sectional view taken along the line 4—4 of FIG. 2.
Figure 2:
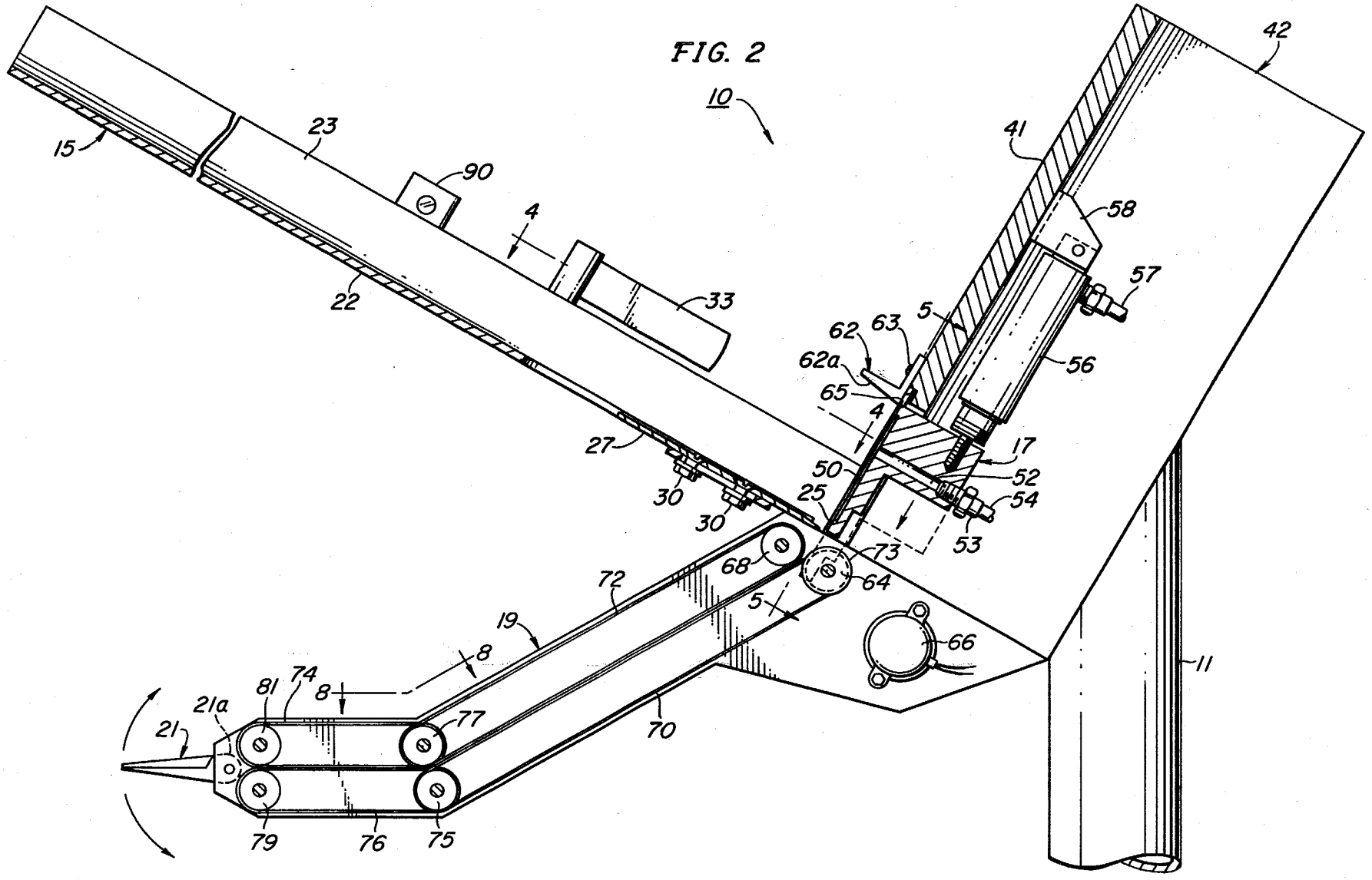
FIG. 2 is an enlarged vertically sectioned, side elevational view of the inserter of FIG. 1.

Referring now to FIGS. 2, 3 and 4, it may be seen that the tray 15 is an open topped channel member having a bottom 22 and a pair of upright side walls or flanges 23. The tray 15 is inclined at an angle of about 30 degrees wherefor the leaflets when stacked therein as shown in FIG. 1, move as a unit under the force of gravity to the lower end of the tray against the face 25 of the suction feed head 17. A gate member 27 is adjustably mounted in a slot 28 provided in the bottom wall 22 of the tray 15 and has a tapered nose portion 28 whose distal end 29 is spaced from the face 25 by a distance but slightly greater than the thickness of each leaflet. A pair of screw and nut assemblies 30 are provided for locking the gate 27 in the adjusted position.

In order to partially support the weight of the leaflets 16 in the tray 15 so that the weight of the leaflets does not overpower the suction feed head 17 when the tray is fully loaded, there is provided in accordance with one aspect of the present invention a novel flow restrictor assembly comprising a pair of resilient or spring-like restrictor fingers 32 and 33 which extend across the upper edges of the side walls 23 into intercepting relationship with the leaflets 16.

The restrictor fingers are flat blades 32 and 33 and are respectively fixed by suitable means such as screws 35 to adjustable posts 36 and 37 rotatably mounted in mounting blocks 38 and 39 attached in any suitable manner to the outer faces of the side walls 23. The posts are angularly adjusted so that the blade 32 extends over the tray at an angle of about forty-five degrees and the blade 33 extends over the tray at an angle of about sixty-degrees. Wherefor the blades act as guides to direct the leaflets from one side to the other of the tray 15 as they move toward the suction feed head.

As best shown in FIGS. 3 and 4 the restrictor blades 32 and 33 are mounted near the lower end of the feed tray in spaced relationship along the direction of travel of the leaflets 16 as they move towards the suction feed head 17. The restrictor blade 32 which initially engages the leaflets 16 is shorter than the blade 33 and being made of the same material is therefore stiffer. The distal end 32*a* of the blade 32 is spaced from the inner surface of the opposite side wall 23 by a distance substantially equal to the corresponding dimension of the leaflets. The distance between the inner surfaces of the walls 23 is somewhat greater than the corresponding dimension of the leaflets and as the leaflets move down the tray and engage the blade 32 they are directed toward the right as shown in FIG. 3 as they move past the end 32*a* of the blade. When the leaflets thereafter engage the restrictor blade 33 they move to the left as shown in FIG. 3. The distal end 33*a* of the blade 33 is spaced from the inner surface of the opposite wall 23 by a distance substantially equal to the corresponding dimension of the leaflets so they may pass thereby.

The use of the two restrictor blades 32 and 33 causes the leaflets to traverse a generally "Z-shaped" zig zag path as they move along the tray towards the feed head. Each of the restrictor blades thus directs the coupons against the opposite side of the feed tray thereby causing the flow of the oncoming leaflets to be restricted. However, the weight of the oncoming leaflets forces the leaflets through the restrictor apertures. By using two restrictor blades rather than one, a lessor force is exerted on each restrictor blade wherefore a finer degree of control can be achieved by selective adjustment of the angles of the blades 32 and 33. The blades 32 and 33 are also provided with longitudinal slots through which the screws 35 extend so that both the angle as well as the effective length of the individual restrictor blades can be adjusted. Also, by using two restrictors even the last leaflet in the stack will feed through the restrictor without departing from its normal position of orientation. It will be understood that the blades 32 and 33 could be replaced with resilient wires or rigid members if desired.

The feed head 17 is mounted for up and down reciprocatory movement to a head plate 41 which forms one side of a control box 42 housing various pieces of control equipment (not shown), such, for example, as pneumatic control valves pressure regulators and the like.

Figure 5:
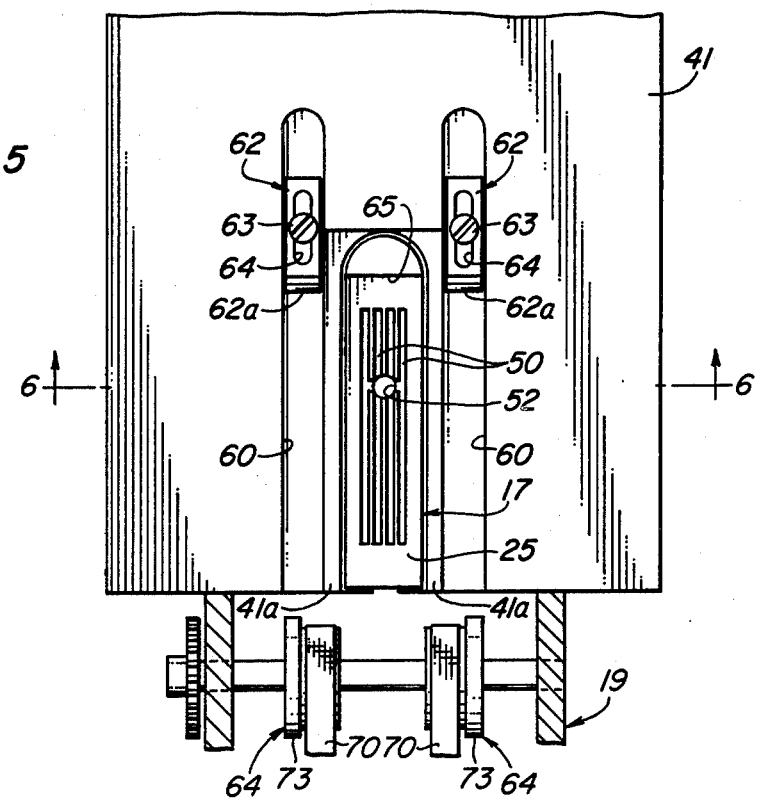
FIG. 5 is a view of the face of the vacuum feed head taken along the line 5—5 of FIG. 2.
Figure 6:
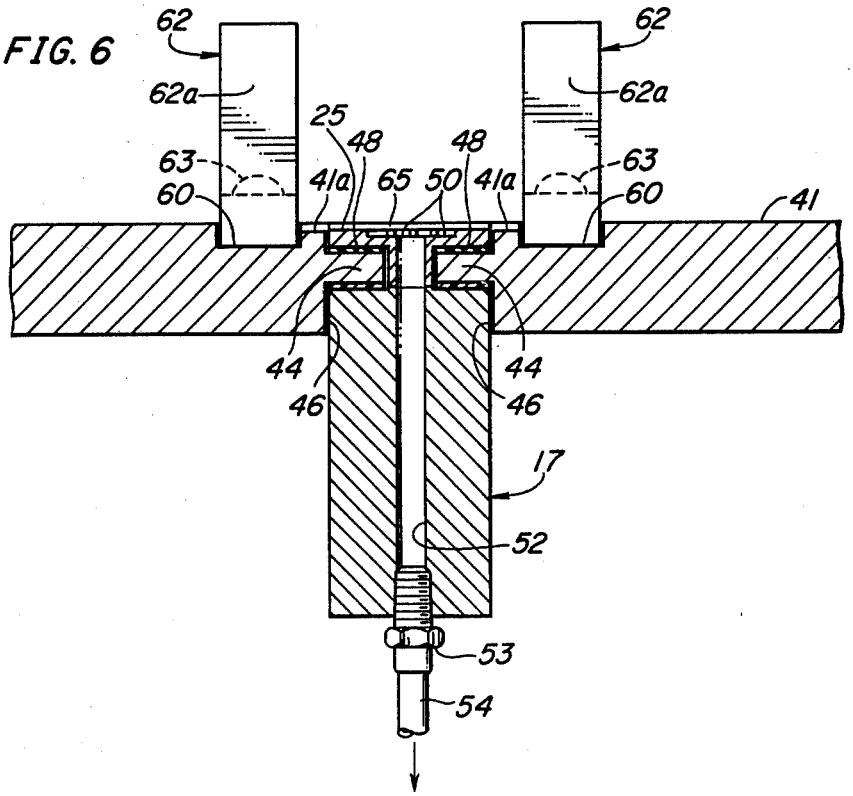
FIG. 6 is a cross-sectional view taken along the line 6—6 of FIG. 5.

As best shown in FIGS. 5 and 6, the suction feed head 17 is slidably mounted on a pair of guide rails or tongues 44 which are integral parts of the head plate 41 and extend into slots or grooves 46 in the feed head. Strips of bearing material 48 are provided on opposite sides of the rails 44 so that the head 17 may reciprocate freely on the rails 44. The front face of the feed head 17, as shown in FIG. 5, is provided with a plurality of elongated parallel interconnected grooves 50 which connect to a central vacuum hole 52 in the rear end of which a fitting 53 is threadably secured. The fitting 53 is connected by a suitable hose 54 to the suction port of a pneumatic vacuum pump, which as explained more fully hereinafter, is continuously operated to continuously provide a continuous suction on the hole 52. The feed head 17 is reciprocably moved along the guide rails 44 by means of a pneumatically operated cylinder-piston assembly 56 connected by an air line 57 to an intermittent source of air which causes the head 17 to reciprocate up and down at a predetermined adjustable frequency or in response to suitable control signals. As shown, the cylinder is mounted via a bracket 58 to the rear face of the head plate 41.

Figure 7:
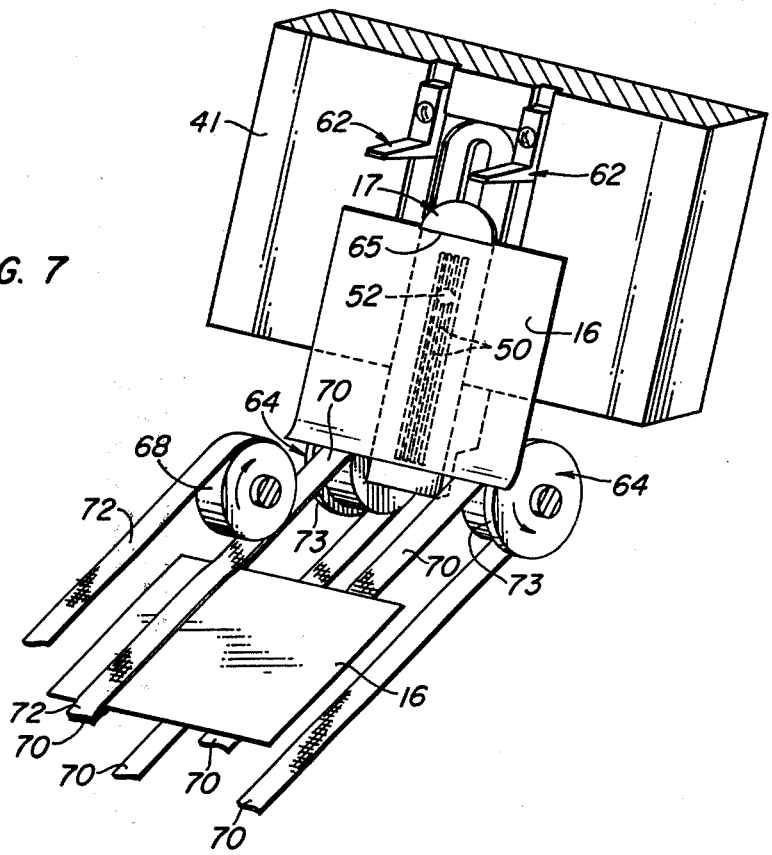
FIG. 7 is a perspective view of a portion of the device of FIG. 1, showing the manner in which the leaflets are inserted between the belts of the leaflet transport mechanism by the suction feed head.

As best shown in FIG. 7, the surface portions 41*a* of the head plate 41 immediately adjacent the vertical sides of the feed head 17 are recessed relative to the face 25 of the feed head. Also, the head plate 41 is provided with two vertical facial grooves 60 respectively disposed adjacent the undercut surfaces 41*a* so that if the leaflets 16 are curled or distorted so that the portion facing the feed plate 41 is concave, the vertical edges of the leaflets will be received in the grooves 60 and extend across the undercut face portions 41*a* so that a suction can be achieved between the face 25 of the feed head and the leaflet. Without these grooves, it is possible that the edges of a curled leaflet will keep the central portion spaced from the suction grooves 50 wherefor the leaflet will not be fed when the feed head is reciprocated.

In order to assure that the leaflet adjacent the head is properly located at the time the feed head 17 moves downwardly, there is provided in accordance with the present invention a pair of guide and stop members 62 which are adjustably mounted to the head plate 41 in the grooves 60 by means of a pair of respective screws 63 extending through slots 64 in the members 62. The lower faces 62*a* of the members 62 are tapered so as to direct any leaflets which may extend above the stack down into the proper position against the feed head 17. The members 62 also perform another function and that is to hold the forwardmost leaflet in place during the return stroke of the head 17 as it is returning to its upmost position after feeding the previous leaflet to the transport mechanism. As has been mentioned hereinbefore, a continuous vacuum is pulled through the hose 54 wherefor as the suction head 17 moves upwardly there is a brief time when a suction may occur on the forwardmost leaflet. In the absence of the stop member 62 that leaflet would thus move up into a different position wherefor on the succeeding forward stroke of the feed head the leaflet would not be in the proper position for insertion into the transport mechanism 19.

As best shown in FIGS. 2, 5 and 6 the face of the suction feed head 17 is provided with a downwardly facing shoulder 65 located a short distance above the lower faces of the stop members 62 when the feed head is in its uppermost fully retracted position. This shoulder functions to physically push the adjacent leaflet into the transport mechanism should the suction be broken before the leading edge of the leaflet has been grasped by the transport mechanism and pulled from the feed head as described hereinafter.

Mounted directly beneath the forward face of the feed head 17 and forming part of the transport mechanism is a roller 64 which is driven in a counterclockwise direction as viewed in FIG. 2 by a motor 66. A second roller 68 which is driven by the motor 66 rotates in a clockwise direction as viewed in FIG. 2. A pair of flexible belts 70 are carried at spaced apart locations on the roller 64 and a similar pair of belts 72 are carried on the roller 68. The belts 70 and 72 are so positioned that they respectively ride tightly against one another between the drive rollers 64 and 68 and a pair of idler rollers 75 and 77 as shown in FIG. 2. The rollers 64 and 68 are driven continuously by the motor 66 and transport the leaflets which are fed into the nip of the belts via the feed head 17 to the lower end of the belts and thence through a second pair of belts 74 and 76 which propel the leaflets through the nozzle 71 to the packages 13.

The lower roller 64 is provided with end flanges 78 which have a greater diameter than the drum parts of the roller carrying the belts 70 and these flanges, as best shown in FIG. 7, are spaced apart by a distance slightly less than the width of the leaflets 16 so that as the suction feed head 17 moves downwardly between the belts 70, the edges of the leaflet being fed to the transport mechanism ride up on the flanges 73 to peel the lower end of the leaflet away from the lower end of the slots 50. In this manner as each leaflet is inserted into the transport mechanism 19, it is peeled away from the lower end of the suction slots 50 to break the suction or vacuum between the feed head and the leaflet so that the leaflet may be pulled freely away from the feed head 17 by the belts 70 and 72. Consequently, a vacuum may be continuously drawn on the feed head enabling considerably higher rates of leaflet insertion than would be the case if the vacuum line had to be switched on and off at the insertion speed.

Figure 8:
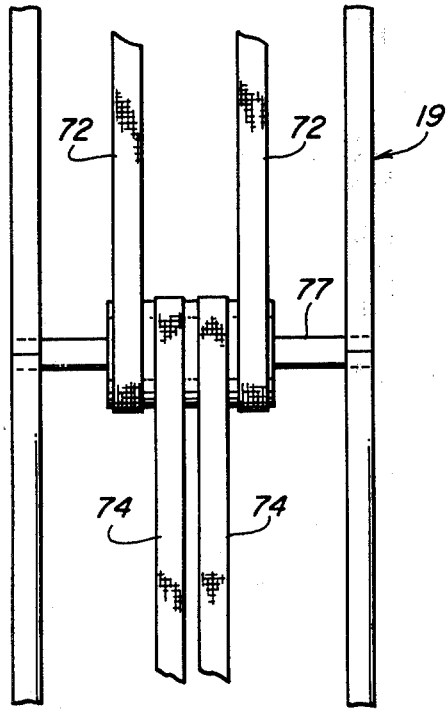
FIG. 8 is a fragmentary view of a portion of the transport mechanism taken from the line 8—8 in FIG. 2.

Referring particularly to FIGS. 2, 5 and 8, the transport mechanism may be seen to incorporate a plurality of idler rollers 75, 77, 79 and 81 journaled in the sides of the transport housing. The rollers 75 and 77 are driven by the belts 70 and 72 and these rollers in turn drive the belts 74 and 76. Inasmuch as all of the belts travel at the same linear speed the leaflets are fed from the belts 70 and 72 to the belts 74 and 76 which in turn propel the leaflets through the nozzle 21. As will be apparent to those skilled in the art, the additional set of belts 74 and 76 is provided to facilitate the propelling of the leaflets in a generally horizontal direction. On the other hand, transport mechanism can be designed so that the belts 74 and 76 travel in a vertical direction for inserting leaflets into the tops of packages or the like. If desired, moreover, the nozzle 21 can be mounted directly at the discharge end of the belts 70 and 72 and the belts 74 and 76 and the associated rollers can be eliminated.

The nozzle 21 includes a pair of ears 51 which are pivotally attached to the sides of the assembly of the frame 19 to permit angular adjustment of the nozzle. The nozzle may have a hinged top snap fitted to the bottom to facilitate unclogging of the nozzle should the leaflets become jammed therein.

Figure 9:
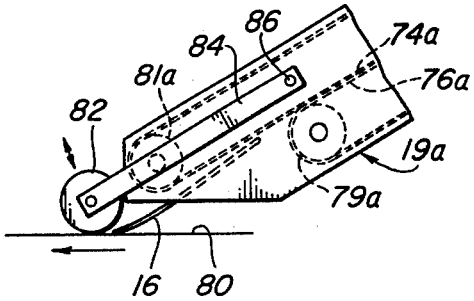
FIG. 9 is a side elevational view of an alternative embodiment of the invention wherein the leaflets are placed on external surfaces of the packages or other articles.

Referring to FIG. 9, there is shown an alternative embodiment of the invention which is used for placing the leaflets 16 on a flat surface 80 moving to the left as shown in FIG. 9. In this embodiment of the invention a roller 82 is mounted for free rotation on the end of a pair of arms 84 which extend from the forward end of the transport mechanism **19*a*. The roller 82 thus rides directly on the surface 80 to which the leaflets are to be applied. As shown, the roller is so positioned that as the leaflets 16 are shot from the discharge end of the belts 74*a* and 76*a* they are directed into the nip between the roller 82 and the surface 80 thereby to prevent the leaflets 16 from bouncing or floating away from the surface 80 as they are directed thereagainst at a very high rate of speed. In this embodiment of the invention, the arms 84 are preferably freely pivotable on pins 86 to the side frame members of the assembly 19*a* so that the roller 82 can move up and down as it follows the surface 80. The weight of the roller is made sufficiently great so that additional spring biasing means or the like need not be employed to hold the roller 82 against the surface 80. It will be understood, however, that if desired such spring means may be employed to prevent bouncing of the roller 82 particularly if the surface 80** is extremely irregular.

OPERATION

In use, the unit 10 is placed next to the packaging or other conveyor 12 and the nozzle 21 or roller 82 is positioned for placement of the leaflets at the desired location in or on the packages or other articles. The gate member 27 is set for accommodating the particular thickness of the leaflets which may be single or folded sheets of paper or the like. A stack of the leaflets are then loaded into the magazine 15 and pushed through the restrictors 32 and 33 against the face of the head plate 41.

When the unit 10 is set into operation a continuous vacuum is drawn through the hole 52 and the motor 66 is energized continuously to drive the belts in the transport mechanism at a high rate of speed of, for example 2700 feet per minute. The head is reciprocated in synchronism with the movement of the articles past the inserter by suitable means. The endmost or lowest one of the leaflets is thus sucked against the face 25 of the feed head 17 and as the head 17 moves downwardly that leaflet is slid downwardly away from the stack and inserted into the nips of the two pairs of belts 70 and 72 as shown in FIG. 2. During this insertion step, the leaflet rides up onto the end flanges 73 of the roller 64 to peel the lower end of the leaflet away from the lower end of the face of the suction head 17 to break the vacuum between the head and the leaflet. As may best be seen in FIG. 2, the plane in which the face 25 of the feed head moves is tangential to the drum portions of the roller 64 wherefor the larger diameter end flanges 73 physically lift the leaflets away from the face 25 and assist in inserting the leaflets into the nips of the belts 70 and 72.

The leaflets 16 are then carried seriatem between the belts 70 and 72, inserted between the belts 74 and 76 and propelled through the nozzle 21 in the embodiment of FIG. 1 or propelled into the nip of the roller 82 in the embodiment of FIG. 9.

As the leaflets are used up, additional stacks of leaflets can be readily placed in the tray 15 without interrupting the operation of the system. If desired, a photosensor 90 may be provided to give an alarm when additional leaflets are required.

As used herein the term leaflet is intended to include folded or unfolded thin sheets of material such as coupons, postage type stamps and the like and the term package includes containers and over-wrapped products.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. Apparatus for feeding leaflets to articles moving past said apparatus, comprising in combination an inclined tray for holding a plurality of said leaflets in face-to-face relationship for movement toward one end of said tray, reciprocating means mounted at said one end of said tray for reciprocal movement in a direction transverse to the direction of movement of said leaflets in said tray, transport means mounted at one end of the path of said reciprocal movement of said feed means for propelling leaflets supplied thereto to said articles as they move past the discharge end of said transport means, feed means carried by said reciprocating means for removing said leaflets one by one from said one end of said tray and feeding them seriatem to said transport means, a plurality of elongated arms extending into the path of movement of said leaflets in said tray, and support means mounting said arms at respectively adjustable angles relative to said path of movement.

2. Apparatus according to claim 1 wherein one of said arms extends into said path of movement from one side of said tray, and the next adjacent one of said arms extends into said path of movement from the other side of said tray, whereby said leaflets travel past said restrictor means in zig-zag fashion as they move toward said lower end of said tray.

3. Apparatus according to claim 2, wherein each of said arms is a leaf spring fixed at one end to said support means and free at the other end.

4. Apparatus for feeding leaflets to articles moving past said apparatus, comprising in combination an inclined tray for holding a plurality of said leaflets in face-to-face relationship for movement toward one end of said tray, reciprocating means mounted at said one end of said tray for reciprocal movement in a direction transverse to the direction of movement of said leaflets in said tray, transport means mounted at one end of the path of said reciprocal movement of said feed means for propelling leaflets supplied thereto to said articles as they move past the discharge end of said transport means, feed means carried by said reciprocating means for removing said leaflets one by one from said one end of said tray and feeding them seriatem to said transport means, a suction member having an apertured face disposed for engagement with the endmost one of said leaflets, and means for continuously sucking air into said suction member to create a vacuum between said apertured face and said endmost one of said leaflets.

5. Apparatus according to claim 4 wherein said transport means comprises means for peeling said leaflets away from said apertured face of said suction member as said leaflets are fed to said transport means.

6. Apparatus according to claim 5 wherein said apertured face comprises a suction area disposed near the edge of the adjacent leaflet which is the leading edge as said leaflet is fed to said transport means.

7. Apparatus according to claim 4 comprising stop means fixedly positioned above said one end of said magazine for limiting upward movement of said leaflets during the return stroke of said feed means.

8. Apparatus according to claim 4 comprising a head plate lying in a plane intercepting said path of movement of said leaflets of an angle of 90 degrees and being disposed at said one end of said magazine, and a guideway in said plate slidably supporting said reciprocating means for said reciprocal movement.

9. Apparatus according to claim 8 comprising means defining parallel undercut areas in said plate adjacent to the path of movement of said suction member for receiving the side edges of non-planar ones of said leaflets to enable the central area thereof to be sucked against said apertured face of said suction member.

10. Apparatus according to claim 6 wherein said apertured face comprises a plurality of facial grooves and at least another facial groove interconnecting said plurality of facial grooves.

11. Apparatus for feeding leaflets to articles moving past said apparatus, comprising in combination an inclined tray for holding a plurality of said leaflets in face-to-face relationship for movement toward one end of said tray, reciprocating means mounted at said one end of said tray for reciprocal movement in a direction transverse to the direction of movement of said leaflets in said tray, transport means mounted at one end of the path of said reciprocal movement of said feed means for propelling leaflets supplied thereto to said articles as they move past the discharge end of said transport means, feed means carried by said reciprocating means for removing said leaflets one by one from said one end of said tray and feeding them seriatem to said transport means, a pair of continuous belts respectively mounted between spaced apart pairs of rollers, drive means for driving said belts at identical linear speeds, said belts being in mutual contact as they travel between said rollers, said feed means feeds said leaflets into the nip between said belts, whereby said leaflets are clamped between said belts and transported thereby, annular flange means on the one of said rollers at the end of said belts to which said leaflets are fed from said feed means, and the periphery of said flange being positioned to peel the lower portion of each leaflet away from said feed means as each leaflet is fed to said transport means.

12. Apparatus for feeding leaflets to articles moving past said apparatus, comprising in combination an inclined tray for holding a plurality of said leaflets in face-to-face relationship for movement toward one end of said tray, reciprocating means mounted at said one end of said tray for reciprocal movement in a direction transverse to the direction of movement of said leaflets in said tray, transport means mounted at one end of the path of said reciprocal movement of said feed means for propelling leaflets supplied thereto to said articles as they move past the discharge end of said transport means, feed means carried by said reciprocating means for removing said leaflets one by one from said one end of said tray and feeding them seriatem to said transport means, tubular nozzle means adjustably mounted at the discharge end of said transport means for controlling the direction in which said leaflets are propelled from said transport means.

13. Apparatus according to claim 12 wherein said nozzle means comprises hingedly interconnected top and bottom portions permitting said nozzle to be opened.

14. Apparatus according to claim 12 wherein said nozzle means is tubular having side walls which converge toward the discharge end of said nozzle means, whereby said leaflets can be accurately directed.

15. Apparatus for feeding leaflets to articles moving past said apparatus, comprising in combination an inclined tray for holding a plurality of said leaflets in face-to-face relationship for movement toward one end of said tray, reciprocating means mounted at said one end of said tray for reciprocal movement in a direction transverse to the direction of movement of said leaflets in said tray, transport means mounted at one end of the path of said reciprocal movement of said feed means for propelling leaflets supplied thereto to said articles as they move past the discharge end of said transport means, feed means carried by said reciprocating means for removing said leaflets one by one from said one end of said tray and feeding them seriatem to said transport means, conveyor means for carrying said articles past said transport means, a roller mounted for free rotation forwardly of the discharge end of said transport means and rotatably resting on a surface of said articles as they move past said transport means and said transport means propelling said leaflets into the nip between said roller and said surface, whereby said leaflets do not bounce off or float away from said surface.

* * * * *